US005396535A

United States Patent [19]

Linhart

[11] Patent Number: 5,396,535

[45] Date of Patent: Mar. 7, 1995

[54] X-RAY APPARATUS COMPRISING A HYDRAULIC SYSTEM

[75] Inventor: Claus Linhart, Hamburg, Germany

[73] Assignee: U.S. Philips Corporation, New York, N.Y.

[21] Appl. No.: 163,253

[22] Filed: Dec. 6, 1993

[30] Foreign Application Priority Data

Dec. 4, 1992 [DE] Germany ..... 4240791.5

[51] Int. Cl.[6] ..... H05G 1/02

[52] U.S. Cl. ..... 378/197; 378/193; 378/195

[58] Field of Search ..... 378/193, 195, 196, 198, 378/177, 208, 197

[56] References Cited

U.S. PATENT DOCUMENTS 4,630,796 12/1986 Kayser et al. ..... 378/193
4,964,149 10/1990 Little ..... 378/167
5,050,202 9/1991 Yanome ..... 378/195

FOREIGN PATENT DOCUMENTS 1014285 8/1957 Germany .

*Primary Examiner*—David P. Porta
*Assistant Examiner*—Don Wong
*Attorney, Agent, or Firm*—Jack D. Slobod

[57] ABSTRACT

An X-ray apparatus includes a hydraulic system for counterbalancing and for displacing an apparatus section; the hydraulic system includes; cylinder with two cylinder chambers whose volumes vary in the opposite sense upon displacement of the apparatus section, and which can be coupled to a hydraulic drive via two respective hydraulic lines. Reliable operation and simple construction are achieved in that the hydraulic drive includes a pump circuit with a flow line and a return line, a control device being provided for optionally blocking or connecting the flow line to one of the two hydraulic lines, the two hydraulic lines communicating with the return line via a valve device which is weighted so that the hydraulic line of higher pressure is still closed relative to the return line but the hydraulic line of lower pressure is open relative to the return line.

16 Claims, 1 Drawing Sheet

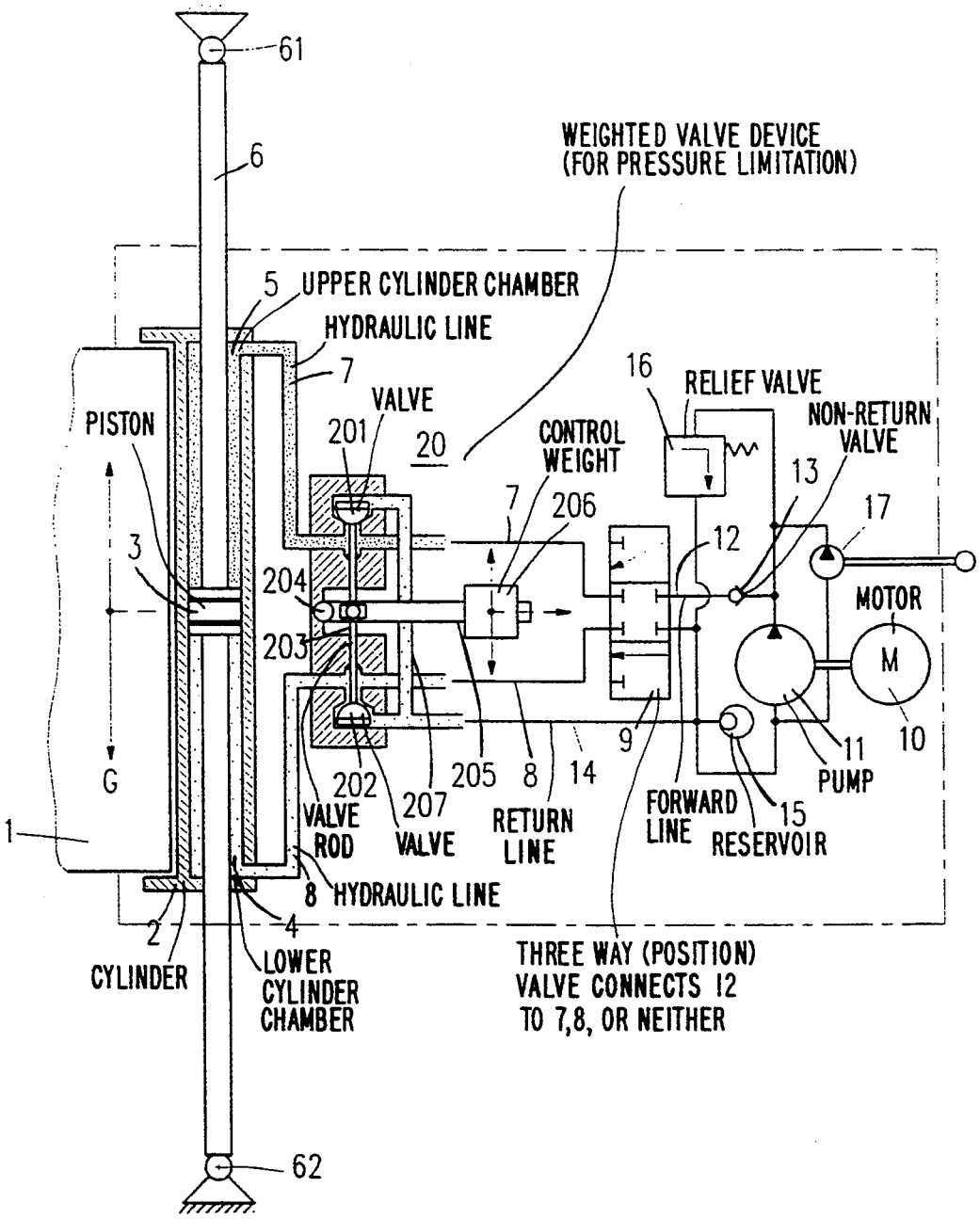
61
6
WEIGHTED VALVE DEVICE
(FOR PRESSURE LIMITATION)
5
UPPER CYLINDER CHAMBER
HYDRAULIC LINE
7
VALVE
201
20
PISTON
CONTROL
WEIGHT
16
RELIEF VALVE
NON-RETURN
VALVE
13
17
7
206
12
3
204
203
MOTOR
M
10
9
11
PUMP
G
202
205
8
14
VALVE
ROD
207
VALVE
RETURN
LINE
FORWARD
LINE
15
RESERVOIR
1
8 HYDRAULIC LINE
2
4
CYLINDER
LOWER
CYLINDER
CHAMBER
THREE WAY (POSITION)
VALVE CONNECTS 12
TO 7,8, OR NEITHER
62

X-RAY APPARATUS COMPRISING A HYDRAULIC SYSTEM

BACKGROUND OF THE INVENTION

1. Field of the Invention

The invention relates to an X-ray apparatus which comprises a hydraulic system for counterbalancing and for displacing an apparatus section said hydraulic system comprising a cylinder with two cylinder chambers whose volumes vary in the opposite sense upon displacement of the apparatus section and which can be coupled to a hydraulic drive via a respective hydraulic line.

2. Description of the Related Art

An X-ray apparatus of this kind is known from U.S. Pat. No. 4,964,149. Therein, the two hydraulic lines communicate, via valves, with a respective reservoir whose size must be sufficient to receive the maximum volume of the associated cylinder chamber. Each reservoir comprises a diaphragm which separates the hydraulic liquid from an air cushion whose pressure can be controlled by means of an operator handle on the apparatus section to be displaced. The known hydraulic system enables counterbalancing and displacement of the apparatus section even when the X-ray apparatus has been rotated through 180° about a horizontal axis, so that the force of gravity acting on the apparatus section changes its direction by 180°. However, the structural volume of the hydraulic system is liable to become comparatively large, notably because of the reservoirs, when the apparatus section is heavy and excessive pressures are to be avoided in the hydraulic system.

SUMMARY OF THE INVENTION

It is an object of the invention to provide an X-ray apparatus which does not require the use of such reservoirs. Counterbalancing and displacement of the apparatus section should again be possible regardless of the position of the X-ray apparatus, without risk of injury to a patient during displacement of the apparatus section.

This object is achieved in accordance with the invention in that the hydraulic drive comprises a pump circuit with a forward line and a return line, that there is provided a control device for closing or connecting, as desired, the forward line to one of the two hydraulic lines, and that the two hydraulic lines communicate with the return line via a valve device which is weighted so that the hydraulic line of higher pressure is still closed relative to the return line but the hydraulic line of lower pressure is open relative to the return line.

When the hydraulic drive moves the apparatus section in a direction in which the volume of the cylinder chamber of higher pressure increases, the hydraulic line connected thereto is initially closed by the valve device. However, when the apparatus section collides with an obstacle for example the patient, the pressure in the hydraulic line increases so that the weighted valve device opens the hydraulic line and hydraulic liquid can flow away via the return line, so that the pressure in this line cannot exceed a value which is dependent on the weight. However, when the chamber of lower pressure is connected to the forward line during displacement of the apparatus section, the hydraulic liquid flows mainly from the hydraulic line connected to this chamber directly into the return line, so that only a very small pressure can be built up by choking.

In a further embodiment of the invention, the hydraulic drive comprises an auxiliary circuit in which a hydraulic liquid can circulate, preferably via a relief valve, without passing through one of the two hydraulic lines. The pump in the pump circuit can thus be switched on already before the control device has connected the forward line to one of the hydraulic lines, without causing the pressure in the pump circuit to become excessively high. When one of the two hydraulic lines is subsequently connected to the forward line via the control device, the pump circuit no longer needs starting up.

In a preferred embodiment of the invention, the valve device comprises two valves for closing each time one of the hydraulic lines relative to the return line, the valves being loaded by at least one control weight acting thereon in a mutually opposite sense in the direction of the force of gravity so that the valve in the hydraulic line of higher pressure is closed and the other valve is open. The excess pressure at which the valve in the hydraulic line of higher pressure opens can be adjusted to a presettable value by a suitable choice of the control weight.

BRIEF DESCRIPTION OF THE DRAWING

The invention will be described in detail hereinafter with reference to the accompanying drawing.

The sole FIGURE of the drawing is a schematic diagram of the X-ray apparatus hydraulic system of the present invention.

The reference 1 in the sole FIGURE of the drawing denotes the apparatus section to be displaced.

DETAILED DESCRIPTION OF THE PREFERRED EMBODIMENT

This may be an X-ray spot film device or a carriage supporting such a device. The apparatus section 1 is connected to a cylinder 2 which is subdivided into a chamber 4 and a chamber 5 by a piston 3. The piston 3 is secured to a piston rod 6 which passes through the cylinder 2 and which itself is connected to two fixed points 61, 62 on the X-ray apparatus (not shown). A hydraulic line 7 is connected to the upper cylinder chamber 5 and a hydraulic line 8 is connected to the lower cylinder chamber 4. These hydraulic lines are represented partly by a single stroke in the drawing.

Instead of a piston 3 which is stationary relative to the X-ray apparatus and a movable cylinder 2, there could also be provided a stationary cylinder and a piston which is movable therein, for example as described in the apparatus disclosed in U.S. Pat. No. 4,964,149 (see FIGS. 1 and 2). In that case the apparatus section should be connected to the piston, being displaceable within the cylinder via guide rollers, instead of to the cylinder.

The two hydraulic lines 7 and 8 are connected, via a three-way valve 9, to a hydraulic drive which is formed by a pump circuit. The pump circuit comprises a pump 11 which is driven by a motor 10 and which is connected to a forward line 12 in which there is inserted a non-return valve 13, as well as a return line 14 which communicates with the pump 11. A pressure equalizing reservoir 15 connected to the return line 14 relieves the hydraulic liquid, for example oil, and provides volume equalization in the event of a change of temperature of the hydraulic liquid. The three-way valve 9 can be coupled to a handle (not shown) for moving the apparatus section 1. When the handle, and hence the three-way valve, is moved downwards, the forward line 12 is connected to the hydraulic line 8 for the lower cylinder chamber 4. As a result, the volume of the lower chamber increases so that the cylinder 2 and the apparatus section 1 move downwards. However, when the handle is moved upwards, the forward line 12 is connected, via the three-way valve 9, to the hydraulic line 7 for the upper cylinder chamber 5. The volume thereof increases, so that the cylinder 2 and the apparatus section 1 move upwards.

Preferably, when the said handle is touched, i.e. before it has been moved so far that the forward line 12 is connected to one of the two hydraulic lines 7 and 8, the motor 10 is switched on via a touch sensor (not shown). When subsequently the connection with one of the two hydraulic lines 7, 8 is established, adequate operating pressure has already been built up. In order to ensure that this motor cannot produce inadmissible pressures before connection to one of the hydraulic lines 7 or 8, there is provided an auxiliary circuit, where either the forward line 12 is connected directly to the storage reservoir 15 or the hydraulic liquid is returned to the storage reservoir via a relief valve 16.

The hydraulic drive must be powerful enough to realise a displacement in the desired direction in any position of the X-ray apparatus, even when the apparatus section is heavy. However, the safety of the patient may not be endangered by such a powerful hydraulic drive. To this end, a weighted valve device 20 for pressure limitation is inserted between the hydraulic drive and the cylinder chambers 4 and 5.

The valve device 20 comprises two valves 201 and 202 which serve for decoupling between the forward line and the return line. When these valves are open, a connection exists between the hydraulic line 7 (via a connection line 207) or 8 and the return line 14, so that hydraulic liquid can enter the return line 14 from said hydraulic line. The valves 201 and 202 are coupled to one another via a valve rod 203. Via a lever 205, being pivotable at 204, a control weight 206 acts on said valve rod 203 so that the valves 201,202 are pulled down, the valve 201 then being closed and the valve 202 opened. The control weight 206 is proportioned so that it closes reliably under the influence of the pressure caused in the upper cylinder chamber 5 by the weight of the apparatus section 1, and opens at a slightly higher pressure to enable the passage of hydraulic liquid from the line 7 directly to the return line 14.

When the load is lifted, as has already been stated hydraulic liquid flows from the forward line 12 into the hydraulic line 7 so that the volume of the upper cylinder chamber 5 increases and the cylinder 2 is moved upwards together with the apparatus section 1. At the same time hydraulic liquid flows into the return line 14 from the lower cylinder chamber, the hydraulic line 8 and the open valve 202. Should the apparatus section collide with an obstacle during the lifting process, for example the chin of a patient, the pressure in the hydraulic line 7 will be further increased so that the valve 201 opens and liquid flows from the hydraulic line 7 into the return line 14 so that the pressure in the hydraulic line 7 cannot increase further.

On the other hand, when the load is lowered, hydraulic liquid will flow from the forward line 12 into the hydraulic line 18 to the lower cylinder chamber 4 in which a comparatively low pressure prevails, which pressure slightly increases due to the inflow of hydraulic liquid. This pressure increase, however, is comparatively small because the valve 202 is open so that the major part of the hydraulic liquid from the hydraulic line 8 flows, via the open valve 202, directly into the return line 14. The pressure increase, however, suffices to increase the pressure in the (initially closed) hydraulic line 7 to such an extent that the valve 201 opens and hydraulic liquid can flow from the cylinder chamber 5 into the return line 14. Should the apparatus section then collide with an obstacle, the pressure in the hydraulic line 7 will drop so that the valve 201 closes and the apparatus section remains stationary.

When the three-way valve 9 occupies its rest position as shown in the drawing, none of the hydraulic lines 7 or 8 communicates with the forward line. The hydraulic lines 7 and 8, therefore, cannot receive hydraulic liquid nor can hydraulic liquid flow away via the open valve 202. The apparatus section remains stationary. When the operator presses the apparatus section 1 downwards in this position of the three-way valve 9 without contacting the handle, and hence without changing the position of the three-way valve 9, the valve 201 opens when the force exerted by the operator 1 exceeds a given value. Hydraulic liquid then flows from the hydraulic line 7, via the valve 201, the connection line 207 and the valve 202, to the chamber 4; the apparatus section 4 is thus lowered. Lifting the apparatus section 4 is not readily possible without assistance from a motor. Therefore, in the case of a power failure, use can be made of a pump 17 which is connected parallel to the pump 11 and which is to be operated by hand, it also being necessary to slide the valve 9 upwards at the same time.

When the X-ray apparatus, along which the apparatus section 1 can be displaced, is rotated clock-wise and about a horizontal axis, the force of gravity acting on the apparatus section 1 and the control weight 206 is no longer directed parallel to the direction of the piston rod 6, as denoted by the dashed arrows. The force exerted by the apparatus section on the hydraulic liquid in the upper cylinder chamber 5 then decreases. However, the force exerted on the valve 201 by the control weight 206 also changes to the same extent. During rotation the pressure in the cylinder chamber 5 or the hydraulic line 7, therefore, first decreases due to the brief opening of the valve 201 until the force exerted by the control weight 206 closes the valve 201 again.

In the horizontal position of the piston rod 6 the weight of the apparatus section 1 does not influence the pressure in the cylinder chambers 4 and 5. In this position the control weight 206 does not load the valves, so that both valves 201 and 202 are open. In the open position of the three-way valve 9 hydraulic liquid then flows from the forward line 12 into either the hydraulic line 7 or the hydraulic line 8. The force thus exerted on the apparatus section 1 is attenuated in that hydraulic liquid can then flow into the return line via the open valve 201 or 202.

When the apparatus is rotated further in the clockwise direction, so that the piston rod 6 reaches the vertical position again from the horizontal position, the valve 202 is closed by the control weight 206, whereas the valve 201 remains open. A function similar to that described with reference to the drawing is then obtained.

I claim:

1. An X-ray apparatus which comprises a hydraulic system for counterbalancing and for displacing an apparatus section, said hydraulic system comprising a cylinder with two cylinder chambers whose volumes vary in opposite senses upon displacement of the apparatus section and can be coupled to a hydraulic drive via two respective hydraulic lines such that said apparatus section is displaced against the force of gravity in response to one of the two hydraulic lines being hydraulic line of higher pressure and the other of the two hydraulic lines being a hydraulic line of lower pressure, said hydraulic drive comprising a pump circuit with a forward line and a return line, a control device for connecting, as desired, the forward line to either of the two hydraulic lines, and a valve device via which the two hydraulic lines communicate with the return line, said valve device being loaded by at least one control weight to bias said valve device toward a position in which the hydraulic line of higher pressure is closed relative to the return line but the hydraulic line of lower pressure is open relative to the return line.

2. An X-ray apparatus as claimed in claim 1, wherein the hydraulic drive comprises an auxiliary circuit in which a hydraulic liquid can circulate without passing through one of the two hydraulic lines.

3. An X-ray apparatus as claimed in claim 2, wherein the control device comprises a three-way valve having a rest position and first and second operative positions, wherein in said rest position, the pump circuit is interrupted, and in the first and second operative positions the forward line is connected to different ones of said two hydraulic lines, respectively.

4. An X-ray apparatus as claimed in claim 3, wherein the valve device comprises two valves connected between different ones of said two hydraulic lines and said return line, said two valves having moveable means for closing paths communicating between different ones of the two hydraulic lines and the return line in response to opposite extremities of movement of the moveable means, the moveable means being loaded by said at least one control weight acting on said moveable means in the direction of the force of gravity.

5. An X-ray apparatus as claimed in claim 4, wherein the pump circuit comprises a first pump which can be driven by a motor, a manually operable second pump being connected parallel to the first pump.

6. An X-ray apparatus as claimed in claim 3, wherein the pump circuit comprises a first pump which can be driven by a motor, a manually operable second pump being connected parallel to the first pump.

7. An X-ray apparatus as claimed in claim 2, wherein the valve device comprises two valves connected between different ones of said two hydraulic lines and said return line, said two valves having moveable means for closing paths communicating between different ones of the two hydraulic lines and the return line in response to opposite extremities of movement of the moveable means, the moveable means being loaded by said at least one control weight acting on said moveable means in the direction of the force of gravity.

8. An X-ray apparatus as claimed in claim 7, wherein the pump circuit comprises a first pump which can be driven by a motor, a manually operable second pump being connected parallel to the first pump.

9. An X-ray apparatus as claimed in claim 2, wherein the pump circuit comprises a first pump which can be driven by a motor, a manually operable second pump being connected parallel to the first pump.

10. An X-ray apparatus as claimed in claim 1, wherein the control device comprises a three-way valve having a rest position and first and second operative positions, wherein in said rest position, the pump circuit is interrupted, and in the first and second operative positions the forward line is connected to different ones of said two hydraulic lines, respectively.

11. An X-ray apparatus as claimed in claim 10, wherein the valve device comprises two valves connected between different ones of said two hydraulic lines and said return line, said two valves having moveable means for closing paths communicating between different ones of the two hydraulic lines and the return line in response to opposite extremities of movement of the moveable means, the moveable means being loaded by said at least one control weight acting on said moveable means in the direction of the force of gravity.

12. An X-ray apparatus as claimed in claim 11, wherein the pump circuit comprises a first pump which can be driven by a motor, a manually operable second pump being connected parallel to the first pump.

13. An X-ray apparatus as claimed in claim 10, wherein the pump circuit comprises a first pump which can be driven by a motor, a manually operable second pump being connected parallel to the first pump.

14. An X-ray apparatus as claimed in claim 1, wherein the valve device comprises two valves connected between different ones of said two hydraulic lines and said return line, said two valves having moveable means for closing paths communicating between different ones of the two hydraulic lines and the return line in response to opposite extremities of movement of the moveable means, the moveable means being loaded by said at least one control weight acting on said moveable means in the direction of the force of gravity.

15. An X-ray apparatus as claimed in claim 14, wherein the pump circuit comprises a first pump which can be driven by a motor, a manually operable second pump being connected parallel to the first pump.

16. An X-ray apparatus as claimed in claim 1, wherein the pump circuit comprises a first pump which can be driven by a motor, a manually operable second pump being connected parallel to the first pump.

* * * * *